United States Patent [19]

Glaser

[11] Patent Number: 4,932,886

[45] Date of Patent: Jun. 12, 1990

[54] SHOCKPROOF ELECTRICAL OUTLET

[76] Inventor: Jeffrey E. Glaser, 32 Henrietta St., Valley Stream, N.Y. 11580

[21] Appl. No.: 289,965

[22] Filed: Dec. 23, 1988

[51] Int. Cl.[5] ..... H01R 13/44

[52] U.S. Cl. ..... 439/137; 439/139; 439/342; 439/188

[58] Field of Search ..... 439/136, 137, 138, 140, 439/141, 142, 147, 188, 342

[56] References Cited

U.S. PATENT DOCUMENTS

| | | | |
|---|---|---|---|
| 3,980,372 | 9/1976 | Ranzanigo | 439/139 |
| 3,990,758 | 11/1976 | Petterson | 439/138 |
| 4,037,901 | 7/1977 | Kaszuba | 439/188 |
| 4,179,175 | 12/1979 | Farnsworth | 439/140 |
| 4,185,881 | 1/1980 | Foley et al. | 439/188 |
| 4,283,102 | 8/1981 | Richier | 439/140 |

*Primary Examiner*—David Pirlot
*Attorney, Agent, or Firm*—Bauer & Schaffer

[57] ABSTRACT

A parallelepiped housing is open on one side and has a face plate moveable toward and away from the rear wall. A movable support holding electrical contacts is provided to receive the blade of a plug. An articulated arm assembly having a free end extending inwardly and bendible on movement of the face plate rearwardly is mounted on the moveable support to occlude the contact in the absence of the insertion of the blade, or in the presence of a blade, to proceed through the hole in the blade and into a channel thereby locking the blade in the slot, or in the insertion of a foreign object to prevent movement of the moveable support. The housing includes electrical contact means fixedly located to the rear of the electrical contact for connection to a source of current.

18 Claims, 3 Drawing Sheets

Fig. 5
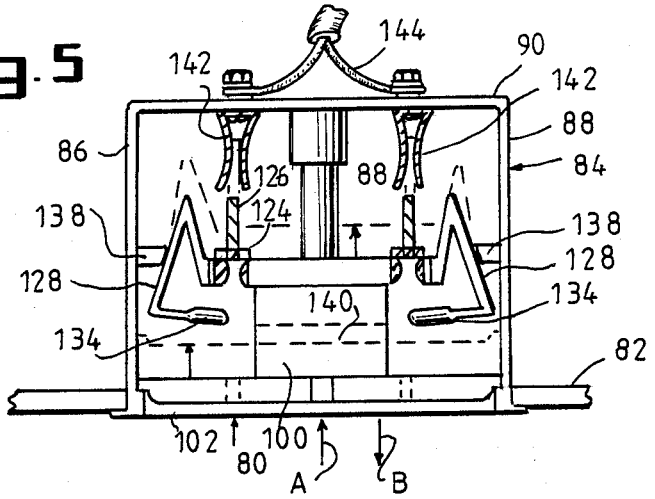
Fig. 6
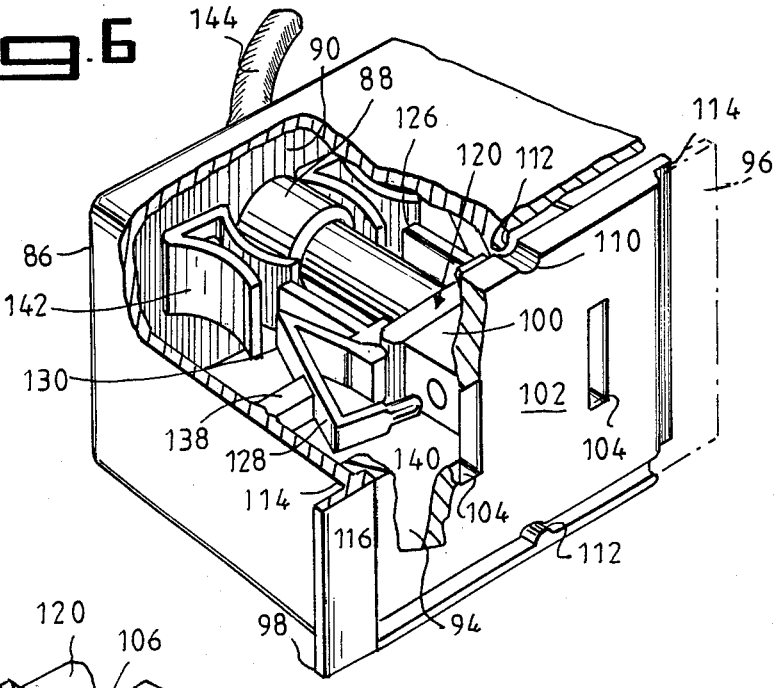
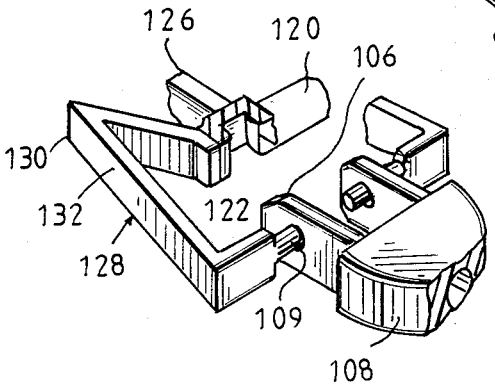
Fig. 7

SHOCKPROOF ELECTRICAL OUTLET

This invention relates to an electrical outlet. More particularly, the invention relates to an improved shockproof electrical outlet.

BACKGROUND OF THE INVENTION

Shockproof or safety type electrical outlets (i.e sockets) are disclosed in U. S. Pat. Nos. 4,544,219; 4,379,697; 4,271,331; 3,990,758; 3,930,704; 2,770,786; 2,336,218; 2,259,096; 2,119,428 and 894,703. While these devices accomplish their purposes in a variety of ways, none of them disclose or suggest an arrangement exhibiting a "pushing" arrangement i.e one operable to permit "safe" entry merely by and through the insertion of the electrical plug. Further, none provides a device of sturdy, yet relatively simple construction.

There exists, therefore, a need for an improved shockproof or safety type electrical outlet which accomplishes such ends. The present invention fulfills such a need.

SUMMARY OF THE INVENTION

According to the present invention, an electrical outlet is provided comprising a housing having a fixed rear wall and a face plate. The face plate is supported in the housing for movement toward and away from the rear wall and has spaced openings for receiving the correspondingly spaced blades of an electrical plug. Electrical contact means are arranged on the supporting means in alignment with each of the openings in the face plate and an articulated arm assembly associated with each of said contact means is provided. The arm assembly is bendable on movement of the face plate and the attached members to occlude the associated contact means in the absence of the insertion of a plug blade through the corresponding opening in said face plate, in the presence of a plug blade to permit free entry of said blade into contact with the corresponding contact means.

The electrical outlet is provided wherein the support means comprises a first member attached to the rear wall and a second member attached to the face plate. The first and second members have cooperating engaging means for guiding the face plate between a forward position and rear position and including means for releasibly maintaining the face plate in the rear condition.

Full details of the present invention, together with the several advantages and objects, are set forth in the following disclosure and shown in the attached drawings.

THE DRAWINGS

In order to understand the present invention more fully, reference is directed to the accompanying drawings which are to be taken in conjunction with the following description of the invention and in which drawings:

FIG. 5 is a plan view particularly in section of another outlet embodying the present invention;

FIG. 6 is a perspective view of the outlet shown in FIG. 5; and

FIG. 7 is a perspective view of the arm assembly in association with the plug blades.

DESCRIPTION OF THE INVENTION

Figure 1:
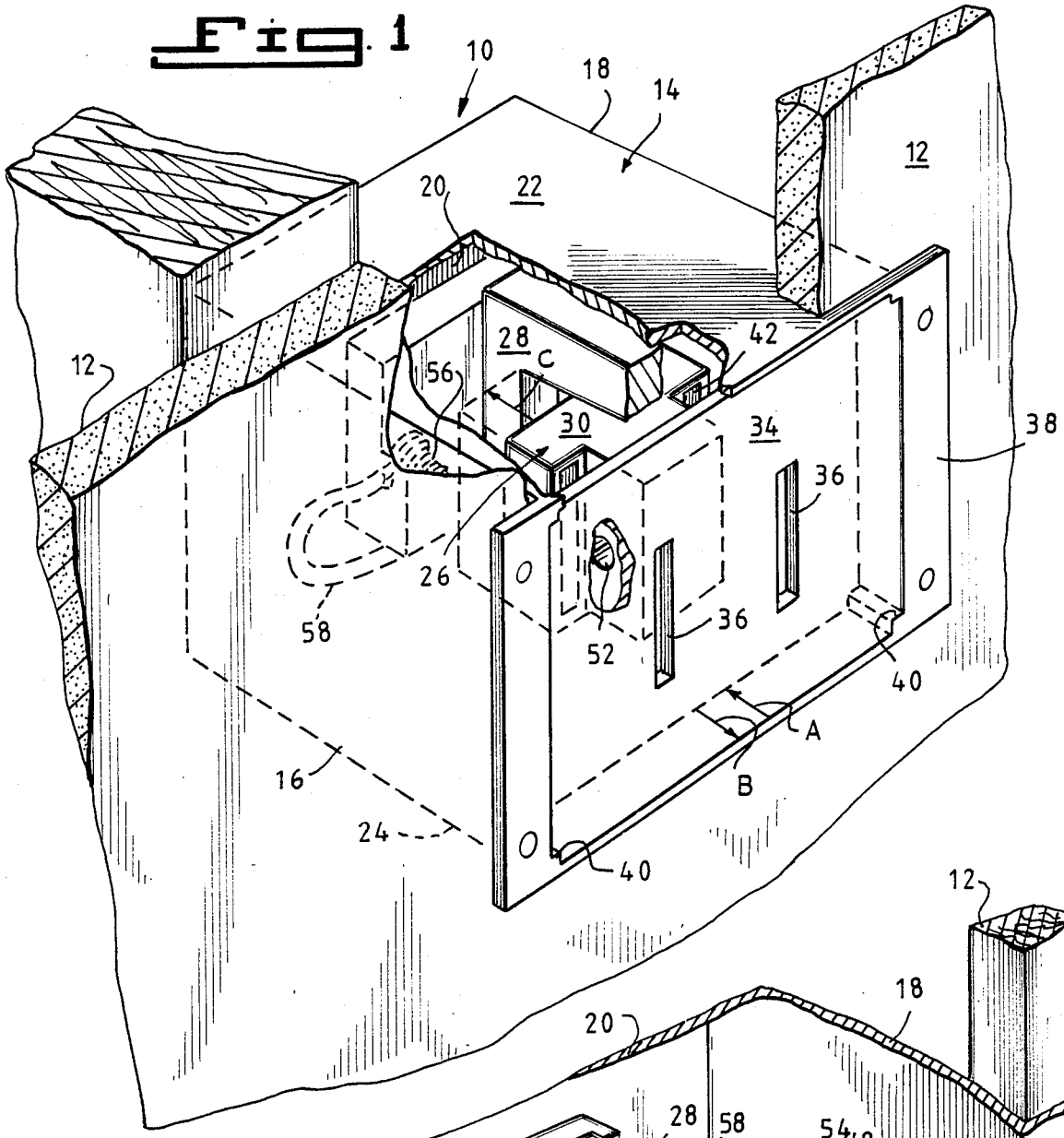
FIG. 1 is a view partially in plan and in perspective of an electrical outlet in accordance with the invention with part of the top wall broken away, and various portions shown in broken lines.

Turning now to FIGS. 1–4, the outlet device of the present invention is generally identified by numeral 10 and is situated in a suitable opening in a mounting wall 12. The outlet comprises a parallelepiped outer housing 14 having side, rear, top and bottom walls 16, 18, 20, 22 and 24, respectively, integrally formed of suitable metal, or fire proof ceramic or plastic, of the types currently conventional for electrical outlet boxes.

Mounted within the housing 10 is an inner operative assembly 26 including a fixed U-shaped panel 28 extending centrally from the rear wall 20 and a mololithic moveable partition 30. The moveable partition 30 fits within the fixed panel 28 so that it can be slideably guided rearwardly and forwardly.

Interposed between the rear of the monolithic partition 30 and the bight of the U-shaped panel 28 is a releasable latch 32, such as a spring loaded and catch rod-in-rod telescoping device of the push-click type, having a releasable depressed hold position and a releasable forward hold position, each requiring a defined push t be moved into the other position.

The moveable partition 30 is attached at the front to a reciprocably moveable face plate 34 by unitarily molding them together or by welding, screwing or otherwise. The face plate 34 is provided with openings or slots for insertions of the blades of a suitable electrical plug which can be of any known conventional style. The use of conventional plugs in the present invention does not require modification or change in such plugs, so long as they contain the usually present hole in each plug blade tip.

The face plate 34 is set within a bezel 38 and is moveable conjointly with the moveable partition portion 30 from front to rear of the housing 10 as indicated by the arrows A and B, for a distance equal to the depth of the distance of transverse of the latch 32. To keep the face plate 34 from twisting or turning, the bezel 38 is provided with square corner inserts 40 which fit into conforming cutouts in the face plate.

Figure 2:
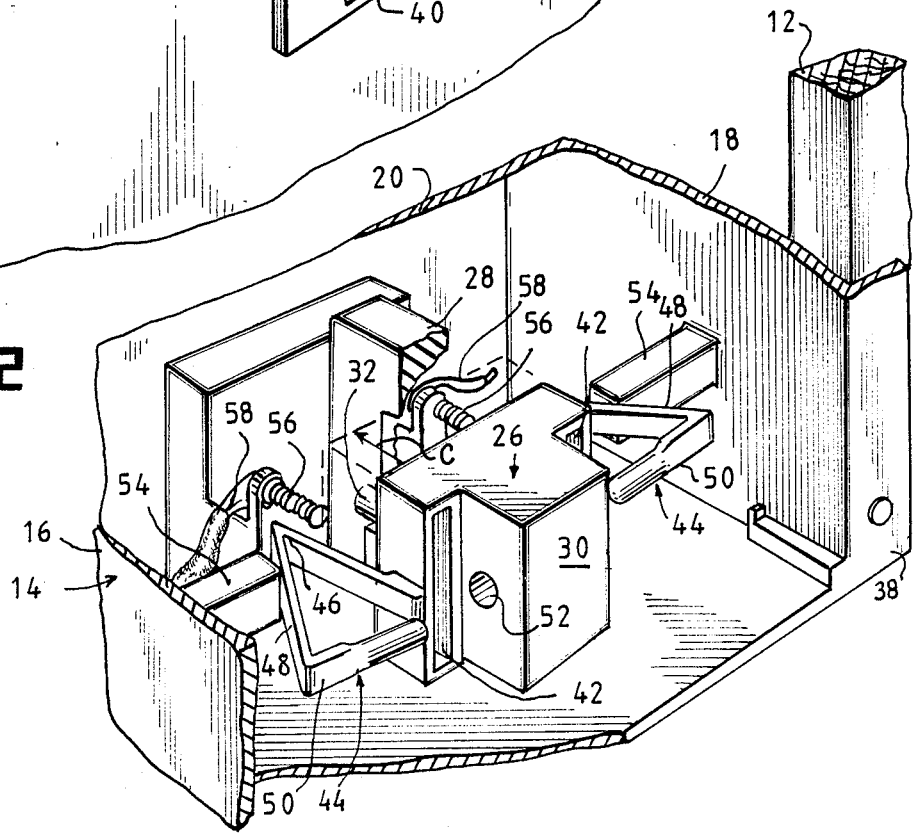
FIG. 2 is a partial plan view of the device shown in FIG. 1 showing in detail, the disposition of the angularly bent arm assembly and cam blocks in their cooperative relationship with the central wall means and fixed and moveable portions thereof.

As seen in detail in FIG. 2, located on each side of the moveable partition 30 of the central partition is a recess channel 42 respectively. The channels 42 are suitably sized to receive the blade of a plug inserted through the face plate; accordingly these channels as well as the slots 36 in the face plate 32 may be rectangular, circular or the like to fit the blade. The channels 42 are lined with copper spring-like members to insure good frictional and electrical contact, as will be described hereafter. Fixedly secured on each of the outer sides of channels 42, is an articulated arm assembly 44 formed of a unitary or integrally formed rigid blade spring, bent triangularly at an elbow 46 to bias a forearm 48 which extends resiliently in the outward lateral direction toward the surface of the side walls 16 and 18 of housing 14 and at an angle thereto so as to resiliently ride on the walls. Each forearm 48 is provided with a prong 50 and which is disposed substantially parallel to the face plate 34, although with a slight angle thereto, which is adapted to fit within a hole 52 formed on the side walls of the monolithic partition 30. Fixed on the inner surface of the side walls 16 and 18 and laterally to each of arm assemblies 44, are cam blocks 54 on which the forearm 48 of assemblies 44 ride when the face plate 34 and moveable partition 30 are pushed inwardly from the front.

The arm assemblies 44 normally extend laterally into contact with the cam blocks 54 on the side walls 16 and 18, so that as the monolith movable partition 30 is pushed (without the insertion of a plug) to the rear (arrow A), the arm assemblies 44 are carried conjointly rearward, while its free prong ends 5. urged inward (arrow C) toward the partition 30, so that they move into the transverse opening 52 in front of the channels 42 (see FIG. 4) blocking entry of any foreign object. On the other hand, in the absence of an inward push on the face plate, the bent resilient arms 44 will be urged outwardly into the normal rest position (FIG. 3) with the prongs 50 disengaged from the slot 52.

Consequently, when a properly shaped and constructed plug is inserted into the slots 36 of the face plate 34, the ends of the plug blade pass over the holes 52. The heel of the plug then abuts against the front surface of the face plate 34. The continued insertion of the plub thus forces the face plate 34 and the monolithic body 30 to which it is attached, to move rearwardly against the spring latch 32. Simultaneously, the ends of the prongs 50 of resilient arm assembly 44 are caused to move laterally toward each other, entering into the holes normally formed in the blades of the plug and fully into the holes 52 in the monolithic body 30.

The lateral holes 52 are placed to the rear of the face plate 34, a distance equal to the length of the plug blade between its hole and its heel so that upon first insertion of the plug, the hole in the blades align with the lateral holes 52 in the monolithic body 30.

At this point, the blade of the plug becomes locked with the lateral prong 44 and with the monolithic body 30 so that the entire assembly moves rearwardly in unison.

If the face plate 34 and monolithic body 30 are pushed in without the insertion, into both slots 36, of a proper plug, then the prongs 44 are permitted to enter into the lateral holes 52. The monolithic body is consequently allowed to move its full distance rearwardly so that contact between contact 56 and 60 (to be explained later) is made, no plug, etc., can thereafter be inserted in the slots 36 because the arms 44 block such entrance. Thus no unwanted electrofication is possible. On the other hand, by insertion of a single blade, or foreign object such as a stick pencil, screwdriver or other device, into one or both of slots 36, the prongs 50 of the arm assemblies 44 will not move into the transverse opening 52 because prong 50 can not go through that object into hole 52. Entire movable sections 30 and 34 can not move rearward because of resistance of cam 54 against artiiculating arm 48 which insure that no electric contact is made with contact points 56 and 60. This prevents unwanted completion of a current circuit within the socket.

Thus extraneous safety features are significant or necessary since in the one instance, even though the faceplate is fully depressed, no circuit can be complete, since the subsequent entry of any object is barred by the latter prong assembly 44. In the second instance, depression of the mololithic body is prevented, preventing the creation of an electrical current, when a foreign object is inserted. Thus, only a properly shaped blade with properly aligned holes will allow both depression and completion of the electrical circuit.

Figure 3:
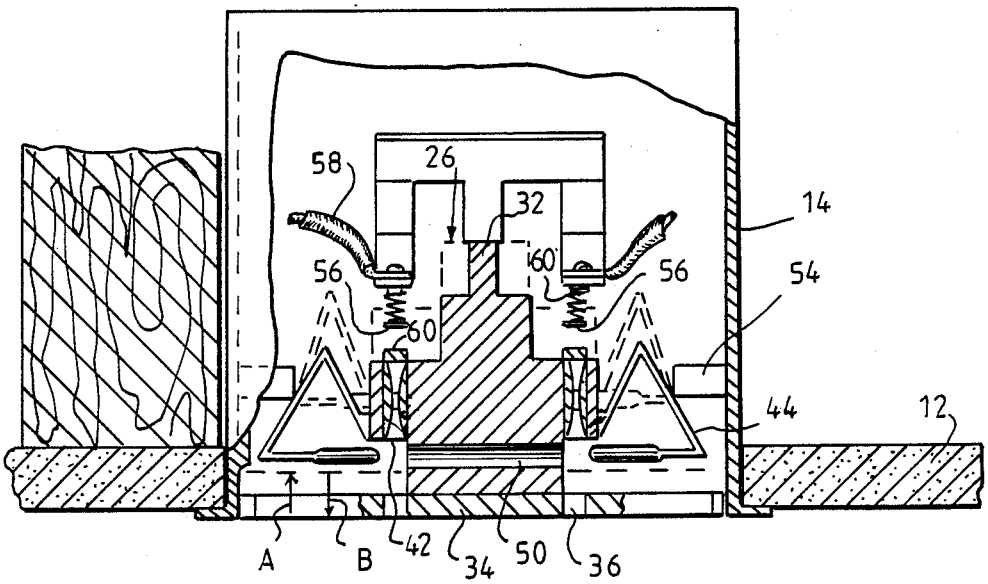
FIG. 3 is a plan view, partially in section of the outlet illustration in FIG. 1 showing the device in a inactive state.
Figure 4:
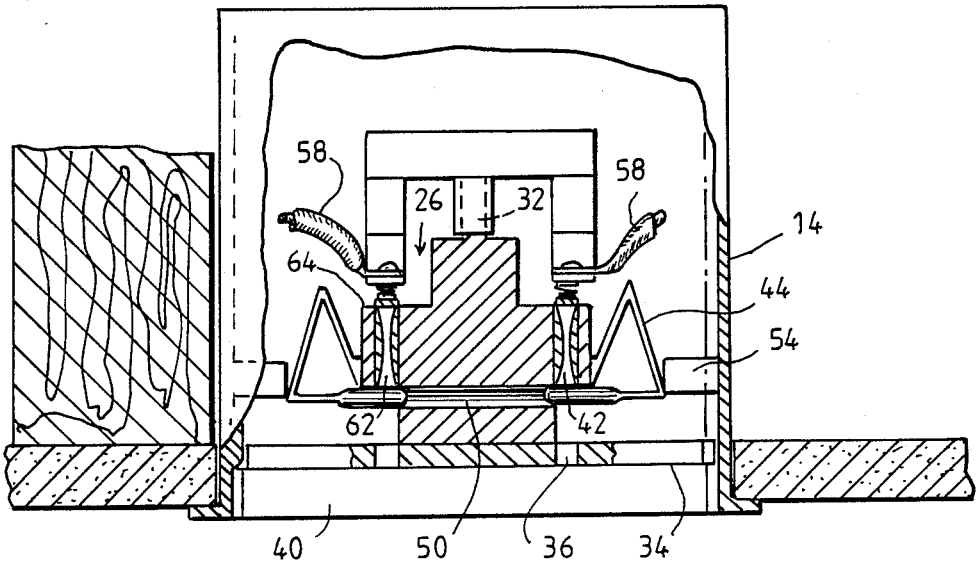
FIG. 4 is a plan view, partially in section of the outlet illustrated in FIG. 1 showing the face plate and moveable portion of the central wall means "pushed in" and the forward prongs of the arm assembly in the transverse opening of the moveable portions, thus preventing access of any type of object to the channel means and preventing shock by undesired closing of the circuit.

As seen in detail in FIGS. 3 and 4, located to the rear of the central partition and mounted adjacent the rear wall 20 in alignment with each channel 42 is an electrical contact 56, conventionally connected to a source of current by wires 58. Contacts 56 are each biased forwardly by compression springs 60. As indicated earlier, each channel 42 is lined with electrical contact material. Such lining is preferably suitable copper or brass contact sleeves 62 which receive in the sleeves, the blades of the plug not shown. The rear ends 64 of the sleeves 62 are enlarged and extend out of the channel to form contact pads respectively aligned squarely with the contacts 56. Therefore, as the face plate 34 and the moveable partition 30 are pushed forward by a proper plug, having a pair of blades, the blades pass into the channels 42 respectively, in the direction of arrow A, causing the moveable partition portion 30 to push the rear ends 64 of the contact sleeves 62 into abuttment with the fixed contacts 56 respectively.

Notwithstanding any possible front to rear bias, caused by the compression springs 60 and/or the resilient arm assemblies 44 (in the direction of arrows A and B) the plug and the operative assembly 26 are secured in the circuit closing position as indicted in FIG. 4 by the releasable push-click latch 32 which holds in its depressed position until the user again pushes the face plate 34, to release the latch 32, allowing the bias of the latch and the other springs to cause the face plate to move forward into the normal outer position. The advantage of this feature in providing a tamper proof socket is obvious. A child attempting to play with the plug, while in the socket, will cause the plug to be immediately expelled, and the circuit contact between the sleeve end 64 and the contacts 56 will be broken.

When the plug is manipulated so as to unlatch the latch mechanism 32 and remove the plug the compression spring within the latch 32 acts act as a restorative force to return the operative assembly 26 to its rest position. Thus, as soon as the plug is pulled in the outward direction (arrow B) the friction between the plug blades and the channels 42 causes the moveable partition 30 and the face plate 34 to move outwardly. Upon complete removal of the plug, the socket device returns to complete rest or inoperative position, as seen in full lines in FIG. 3.

A second embodiment of the present invention is illustrated in FIGS. 5, 6, and 7. Here the outlet device is generally identified by numeral 80 and adapted to be situated in a suitable opening in a mounting wall 82. The outlet comprises an outer housing 84 having side, rear, top, and bottom walls 86, 88, 90, 92, and 94, respectively, and a perimetal bezel 96. The housing is integrally formed of suitable nonconductive or fire proof ceramic or plastic of the types currently conventional for electrical outlet boxes, since as will be seen later, the housing seems to directly support certain electrically conductive components. Of course, if desired, a surrounding non-conductive sleeve, shield or the like, can be applied over the housing.

Mounted within the housing 84 is a releasable latching support 98, preferably a rod-in-rod telescoping device having a resilient push-click release mechanism in its interior, as earlier described. One rod member extends centrally from the rear wall 90 while the other rod member is secured at its front end to a monolithic block 100, itself secured at the center of a movable face plate 102. The face plate 102 is provided with openings or slots 104 for insertions of plug blades 106 of a suitable electrical plug 108, (see FIG. 7) which can be of any known conventional style provided with the usual holes 109.

The face plate 102 is set within the housing 84 and is reciprocatable conjointly with the latching support 98 from front to rear of the housing 84 as indicated by the arrows A and B for a distance equal to the throw or movement of the latching support 98. To insure linear movement of the face plate 102, the upper and lower edges of the face plate are provided with a notch 110 which slides over a conforming shaped ridge 112 formed on the face of the top and bottom walls 92 and 94 of the housing. In this manner the face plate 102 tracks linearly as it moves in the direction of arrows A and B. The lateral or vertical edges of the face plate are bevelled to provide an outwardly directed lip 114 which slides against the interior surface of the side walls 86 and 88, respectively, and which seat against an inwardly directed flange 116 formed on the bezel 96. If desired, the side lip 114 and side walls 86 and 88 can also be formed with tracking notches and ridges.

Mounted to the monolithic block 100 at each of its lateral interior rearmost edges is a plug blade contact seat assembly comprising a unitary molded plastic bridge member 120 at the lateral ends of which are inserted a pair of semi-circular brass or copper conductive contacts 122 integrally connected by a web or wall 124 of the same conductive material. The two semi-circular contacts are spaced from each by a distance slightly less than the thickness of a plug blade 106 and of such depth as to resiliently receive a tip of the plug blade, thereby eliminating sparking or arcing when electrical contact is made. Extending rearwardly from the web wall 124 is a straight rigid blade 126, formed of the same conductive material as the contacts 122. Preferably the blade 126 is made integrally with the contacts 122 and web 124.

Integrally formed with the bridging member 120 of the contact assembly and extending from each of the lateral ends thereof, is an articulated arm assembly 128 formed of a unitary or integrally constructed flat blade-like spring bent at an elbow 130 to bias a forearm member 132 which extends resiliently in the lateral direction toward the inner surface of the side walls 86 and 88. Each forearm 132 is provided with a prong 134 and which is disposed substantially parallel to the face plate 102 although with a slight angle thereto. Preferably the entire bridging member and 128 are made of molded plastic resin, so as to be relative, rigid and function as an insulating member. The contacts 122, web 124 and blade 126 are preferably high conductivity copper and embedded in situ during molding or embedded afterward.

Fixed on the inner surface of the side walls 86 and 88 are cam blocks 138 on which the forearms 132 ride when the face plate 102, and the movable block 100 carried by it are pushed inwardly by operation on the face plate 102. The arm assemblies 128 normally extend laterally into contact with the cams 138 on side walls 84 and 86 so that as the monolithic block 100 is pushed to the rear (arrow A), the prongs 134 are urged medially inward toward the block 100. The block 100 is provided with transverse opening 140 in its side walls into which the prongs 138 is adapted to fit as a result of being pushed medially inward.

Consequently, only when a properly shaped and constructed plug is inserted into the slots 104 of the face plate 102, do the prongs 136 move toward each other through the hole 109 in the blade 106 and into the hole 140. As a result all of the operative assembly fastened into the face plate, i.e. electric plug 108, block 100 and contacts 122, etc., will move rearwardly toward the rear wall without any interference. The entire group moves rearwardly as one body, shortening the telescoping latching support 98 until it nears its rearmost position where it clicks into place to be held until released.

The safety concepts of the present invention are similar in this embodiment as in the earlier described embodiment in that, when the faceplate 102 is depressed without the insertion of a proper plug, the arm assembly 128 prevents any subsequent completion of an electrical current and when a foreign object is inserted, the depression of the body is prevented, thus preventing any electrical contact within the socket.

Mounted on the rear wall 90 and straddling the latching support 98 are a pair of electrical contacts 142 each conventionally connected to a source of current by wires 144. The contacts 142 are scabbard or leaf-like spring blade contacts, having a pair of arcuate spring-like leaves biased in contact with each other and capable of frictionally receiving the rigid blade 126 extending rearwardly from contact assembly 122. Thus, on the insertion of a suitable plug, through the face plate, the tip end of the plug seats within the contact assembly 122, permitting thereafter the entire assemblage to move rearwardly in the direction of arrow A. The rearward movement allows the blade 126 to then seat within the leaf contact 142 completing the electrical circuit as the latching support 98 locks in depressed position. In order to remove the plug, the face plate 102 must be pushed in once again to release the push-click latching support 98, allowing the entire assembly to move forwardly free of hinderance.

It is thus seen from the foregoing that a simple economical construction of an electric outlet socket or plug receptacle is provided by the present invention. The present device is safe and short circuit or unwanted closure of a circuit can not be made by merely inserting elongated prongs, wires, keys or the like, into the face slots. In order to make circuit closure, the properly shaped plug blades must be simultaneously inserted, otherwise the route to the contacts through the channels, is blocked and movement of the circuit contact prevented.

While a two pole socket has been shown, it is apparent that, when three or more holes, or a ground connection is used, the socket can be modified to be adapted to the shape and number of blades on the plug, with the additional blade sites provided, if desired, with the blocking system, i.e arm assembly, etc., of the present invention. The socket can easily be rendered in round or circular form, rather than rectangular as shown.

The various elements of the outlet device of the present invention, such as the housing, central partition springs and angularly bent flat spring, as well as the face plate, may be made from plastics or metals. Obviously, the elements upon which contact or flow of current depends, should be made of copper brass materials as known in the electrical industry.

Numerous modifications of the described embodiments of the present invention can be made without departing from the spirit and scope of the present invention. It is to be understood, therefore, that the present invention is not to be limited to the above described embodiments thereof, except as defined in the appended claims.

It will be obvious, that overall, the present invention has a shape and size that makes it readily adapted for use with existing junction boxes, and decorative faceplates. Therefore, modification of existing electrical sockets, plugs on circuitry is unnecessary.

What is claimed is:

1. An electrical outlet comprising a housing having a fixed rear wall and a face plate, means supporting said face plate in said housing for movement toward and away from said rear wall, said face plate having spaced openings for receiving the correspondingly spaced blades of an electrical plug, electrical contact means arranged on said supporting means in alignment with each of the openings in the face plate, an articulated arm assembly associated with each of said contact means, means mounted on said side walls of said housing to engage said articulated arm assemblies and causing said arm assemblies to bend; on movement thereof to occlude the associated contact means in the absence of the insertion of a plug blade through the corresponding opening in said face plate; in the presence of a plug blade to permit free entry of said blade into contact with the corresponding contact means; and, in the presence of a foreign object to prevent movement of said supporting means and completion of an electrical current.

2. The electrical outlet according to claim 1 wherein said support means comprises a first member attached to said rear wall and a second member attached to said face plate, said first and second members having cooperating engaging means for guiding said face plate between a forward position and rear position and including means for releasably maintaining said face plate in each position.

3. The outlet according to claim 2, wherein said second member is provided with a transverse hole for receiving the free ends of said articulate arm assemblies and in the absence of a blade, to occlude the contact means.

4. The outlet according to claim 3 wherein first and second members are telescopingly arranged one within the other and provided with a spring biased latching mechanism to releasably hold said members in the second position.

5. The outlet according to claim 3 wherein first and second members are telescopingly arranged one within the other and provided with a spring biased latching release mechanism to releasably hold said members in the second position.

6. The outlet according to claim 3 wherein said first and second members each comprise a partition wall extending perpendicularly to said rear wall and face plate respectively, said first and second partitions being parallelly movable relatively to each.

7. The outlet according to claim 6, wherein said electrical contact means comprises a moveable contact and spring means to bias said contact in abutment with said blades.

8. The outlet according to claim 7, including a conductive sleeve located within a recess in said central partition, said sleeve extending outwardly from the rear of said recess toward said electrical contacts.

9. An improved shockproof electrical outlet comprising a housing having side, rear, top and bottom walls, a central partition located in said housing having a fixed portion and moveably portion, a reciprocable face plate provided with openings for insertion of the blade prongs of an electrical plug disposed at the outer end of and perpendicular to said moveable portion of said wall means, recess channel means closed at the inner end with electrical contact means disposed on opposite sides of said moveable portion of said partition and which are adapted to receive the blades of said prongs, angularly bent spring means extending from the sides of said channel means toward the side walls of said housing at an angle thereto and resiliently riding on the surface thereof and which have forward ends shaped as prongs extending substantially parallel to said face plate, but at a slight angle thereto, said moveable portion of said partition being provided with a transverse opening located between said channel means and said face plate and in which, the prongs of said spring means extend when said face plate and said moveable portion of said wall means are moved toward the rear wall of said housing without insertion of the blade prongs of said electrical plug into the openings thereof to occlude the associated channel means, and when blades are inserted into said openings said spring means moving toward each other to permit said springs to pass through the holes in the blade into the transverse opening, and electrical contact means located on the fixed portion of said partition toward the rear of said housing for providing current to the electrical contacts on said channel means when said face plate and moveable portions of said partition are moved toward the rear portion of said housing.

10. An electrical outlet according to claim 9, including cam blocks fixed on the inner surface of the side walls of the housing in contact with the spring means, said spring means riding on said cam blocks when the face plate and moveable portion of the central partition are pushed inwardly.

11. An electrical outlet according to claim 9, wherein the angularly bent spring members are triangularly shaped.

12. An electrical outlet according to claim 9, wherein the angularly bent spring members are triangularly shaped and the base prongs of the triangles are adapted to move toward each other in the transverse opening in the moveable portion of the wall means, to simultaneously lock said blade therewith.

13. An electrical outlet according to claim 9, wherein the electrical contact means located on the fixed portion of the central wall means are spring biased.

14. An improved shockproof electrical outlet comprising a housing having side, rear, top, and bottom walls, an operative assembly disposed in said housing including a reciprocatable face plate provided with openings for insertion of the blades of electrical plugs, and means for supporting said face plate for movement toward and away from the rear wall comprises a first member attached to said rear wall and a second member attached to said face plate, said first and second members having cooperating engaging means for guiding said face plate between a forward position and rear position and including means for releasibly maintaining said face in said rear condition, first electrical contact means disposed on the opposite sides of said second member adapted to receive the blades of the plug, an articulated arm assembly extending outwardly from the sides of said contacts toward the side walls of said housing at an angle thereto and resiliently riding on the surface of said side walls, each of said arm assembly having a forward end shaped as prongs extending substantially parallel to said face plate, said second member being provided with transverse openings in to which the ends of said arm assembly extend, said arm assembly being operable to block access to said first electrical contacts when said face plate is moved toward the rear wall of said housing without insertion of the blade of said electrical plug into the corresponding opening of said face plate and prevent access to said first electrical contacts, and operable upon insertion of a blade to permit full movement of said operative assembly allowing said blades access to said first electrical contacts and, second electrical contact means locates on said rear wall of said housing and connected to a source of current to said second electrical contact and conductive means extending from the rear of said first contact means engaging said second contact means when said operative assembly is moved into its forward position.

15. The outlet according to claim 14 wherein said conductive means comprises a rigid blade formed integrally with said first contact means, and said second contact means comprises a pair of leaf springs arranged to receive said blade.

16. An electrical outlet according to claim 14, including cam blocks fixed on the inner surface of the side walls of the housing and to the rear of the articulated arm assembly which ride on said cam blocks when the face plate is pushed inwardly.

17. An electrical outlet according to claim 16, wherein the arm assembly comprises angularly bent spring members.

18. An electrical outlet according to claim 16, wherein the angularly bent spring members are triangularly shaped and the prongs of the triangles are adapted to move toward each other in the transverse opening in the moveable portion of the second member.

* * * * *